United States Patent [19]

Brusadin et al.

[11] Patent Number: 4,768,546

[45] Date of Patent: Sep. 6, 1988

[54] HOSE WINDING CART

[75] Inventors: Giacomo Brusadin, Pordenone; Alladino Borghese, Malnisio, both of Italy

[73] Assignee: Umiflex Utiltime S.p.A., Pordenone, Italy

[21] Appl. No.: 40,474

[22] Filed: Apr. 20, 1987

[30] Foreign Application Priority Data

May 2, 1986 [IT] Italy ..... 45723 A/86

[51] Int. Cl.[4] ..... B65H 75/34

[52] U.S. Cl. ..... 137/355.27; 137/580; 242/86

[58] Field of Search ..... 137/355.16, 355.26, 137/355.27, 580; 242/86

[56] References Cited

U.S. PATENT DOCUMENTS

| | | | |
|---|---|---|---|
| 3,977,429 | 8/1976 | Stevenson | 137/355.27 |
| 4,137,939 | 2/1979 | Chow | 137/355.27 |
| 4,506,698 | 3/1985 | Garcia et al. | 137/355.27 |
| 4,512,361 | 4/1985 | Tisbo et al. | 137/355.27 |

FOREIGN PATENT DOCUMENTS

| | | |
|---|---|---|
| 0131219 | 6/1984 | European Pat. Off. . |
| 2452458 | 10/1980 | France . |

*Primary Examiner*—A. Michael Chambers

*Attorney, Agent, or Firm*—Wenderoth, Lind & Ponack

[57] ABSTRACT

A hose winding cart including a handle, a base including wheels, a pair of identically shaped lateral arms, a reel, a first stud and a second stud. The pair of lateral elements are connected to the handle and the base at positions which are spaced apart in a longitudinal direction. The reel for winding a hose thereon includes a pair of identically shaped reel halves, each of the reel halves having snap connections thereon for interconnecting the reel halves to form the reel. The first stud is connected between one of the lateral elements and one of the reel halves for rotatably supporting one side of the reel, the first stud having connections thereon for supplying a fluid medium to a hose carried by the reel. The second stud is connected between the other one of the lateral elements and the other one of the reel halves for rotatably supporting the other side of the reel. The second stud includes a crank extending therefrom for rotating the reel.

20 Claims, 9 Drawing Sheets

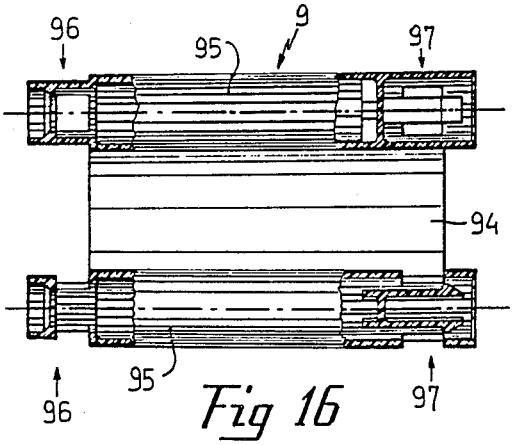
Fig 16
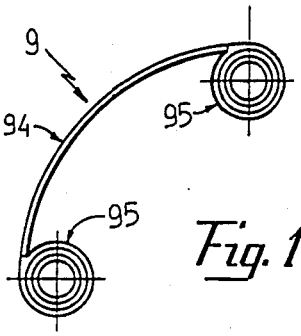
Fig. 17
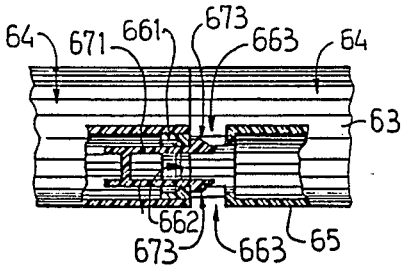
Fig. 5
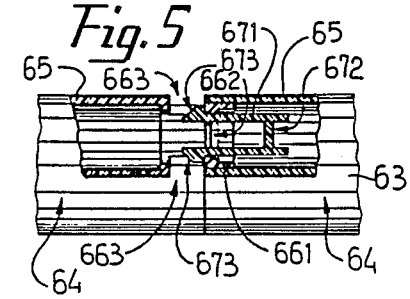
Fig. 15
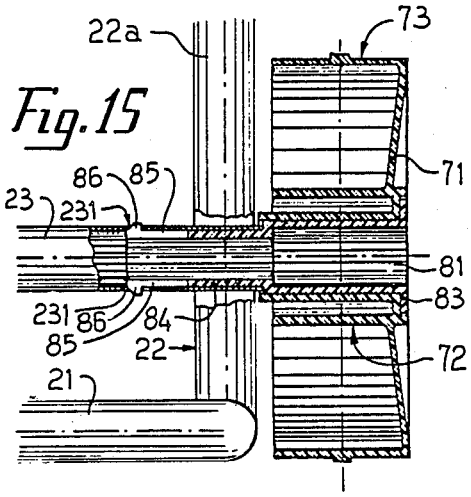

HOSE WINDING CART

BACKGROUND OF THE INVENTION

1. Field of the Invention

The present invention relates to a hose winding cart, which may be particularly employed for gardening purposes.

2. Description of the Prior Art

Suitable devices are well known and widely used, particularly in the gardening field, which devices permit a sufficient quantity of hose to be stored in an adequate spool, by winding it normally around the same spool, which in turn is so shaped as to permit the whole to be shifted.

In the case of devices provided for having limited performances and therefore also with limited sizes, the spool is applied merely to a suitable structure comprising a handle or forming a handle or the like, which permits the user to grasp it for effecting the displacements thereof.

On the contrary, in the case of devices provided for having considerable performances, also the spool is provided with larger sizes and therefore is adequately supported by a suitable structure provided with wheels, so forming an effective cart, wherein such kinds of devices are commonly called "hose winding carts".

Thus, a large range of hose winding carts is known and utilized, which arts are shaped substantially in a very similar manner as they are constituted by different elements, which are assembled together in various manners and which carts differ from each other merely in some constructive parts and especially in the relevant assembling system thereof.

Normally, the different component parts of such hose winding carts are assembled and fixed together, in a more or less removable manner, by means of suitable connection elements like screws, bolts, nuts, etc. and they always require adequate tools to be utilized in combination therewith.

In some cases, any constructive parts thereof may be assembled by means of snap connections, which however normally provide connections practically irreversible. Therefore, it appears evident that it is as much as ever appropriate to provide a device of the kind referred to, which results in a construction constituted by a small number of component parts which may be assembled in an easier way and which also permit the relevant assembling and disassembling thereof to be performed in a very simple and quick manner as well as without the need of any tool, so as to always have available a group of elements provided with reduced overall dimensions when they are disassembled, and consequently to provide advantages both in the storage and transport thereof.

SUMMARY OF THE INVENTION

The hose winding cart according to the present invention permits all the above specified objects to be obtained, which cart is basically constituted in a per se known manner by: a handle and a base element, both formed from an adequately shaped metallic tube and which are reciprocally interconnected by two lateral elements, which elements are able to receive respectively, the first one a first stud whose end portions are provided with connections to permit the hoses to be connected therein, and the other one thereof a stud provided with a crank, wherein such studs are able to support at their resulting inner end portions a spool for winding an adequate portion of a hose, and the base element is also provided laterally with two wheels, and wherein such a hose winding cart is characterized in that all the component elements thereof, excluding both the handle and the base element which are made of metal, are made of plastic and the most part of the same has double functions during the cart assembling, wherein all the different component elements thereof may be assembled together and reciprocally interconnected by means of a simple snap connection, which is obtained through adequate connecting means constituted by resiliently deformable coupling elements, which are provided on a component element thereof are able to be coupled with correspondent recesses provided on the component element which is complementary with respect to the first one, and wherein all the coupling elements may be accessible and operated in their uncoupled condition without need of any tool.

BRIEF DESCRIPTION OF THE DRAWINGS

The features and advantages of the hose winding cart referred to above will be better understood with reference to a preferred embodiment thereof, by way of a not limiting example, which will be hereinafter described in detail referring to the attached drawings, in which:

FIG. 5 shows an enlarged view of the connection of the two half-spools shown in the preceding FIGS. 3 and 4, in order to form the winding spool;

FIGS. 12, 13 and 14 show the wheel stud in an end view and side views, respectively, wherein FIG. 14 is a sectioned view taken along the line III—III of FIG. 12;

FIG. 15 shows a cut-away view of the assembling system of a wheel to the base element of the hose winding cart according to the present invention;

FIGS. 16 and 17, respectively are a partial cut-away front view and a corresponding side view of an enlargement element, which may be inserted between the two half-spools for obtaining an enlargement of the same spool;

DETAILED DESCRIPTION OF THE PREFERRED EMBODIMENTS

In the above mentioned figures, like elements are identified by the same numerical references.

Figure 1:
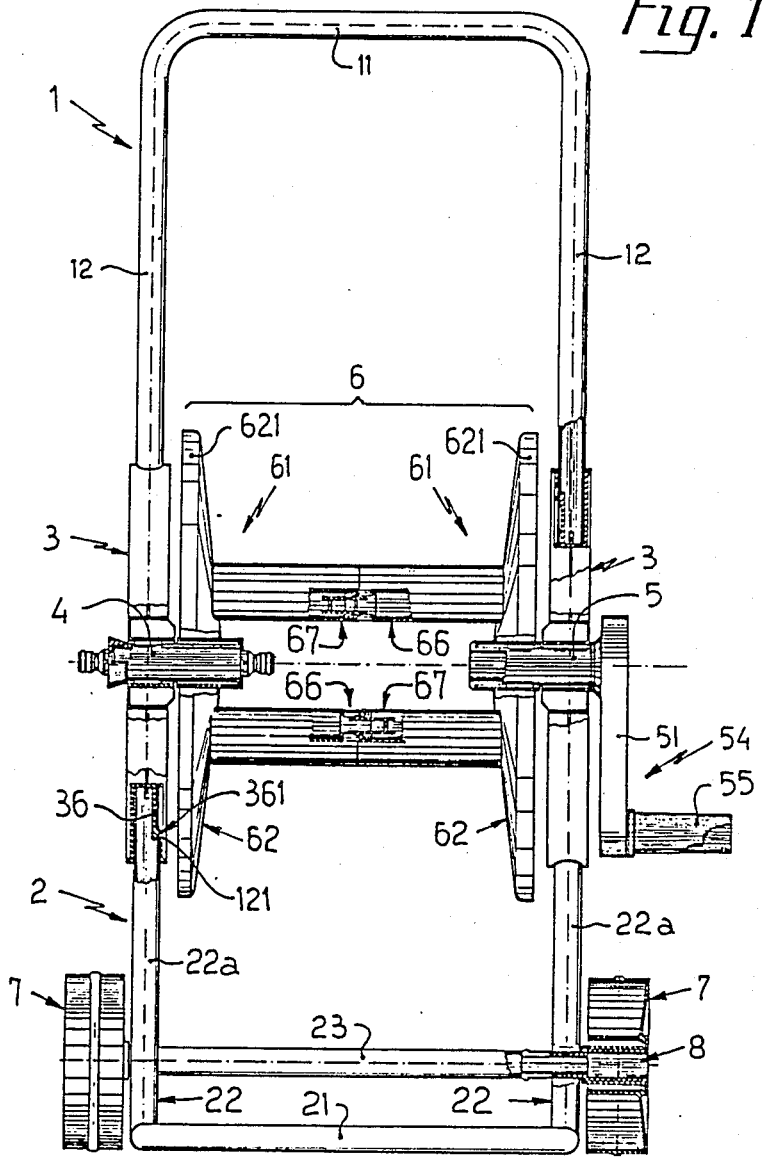
FIG. 1 shows a front view of the hose winding cart according to the present invention, which illustrates the connecting systems for the reversible connections of the different component elements, which systems are cut-away in part.
Figure 2:
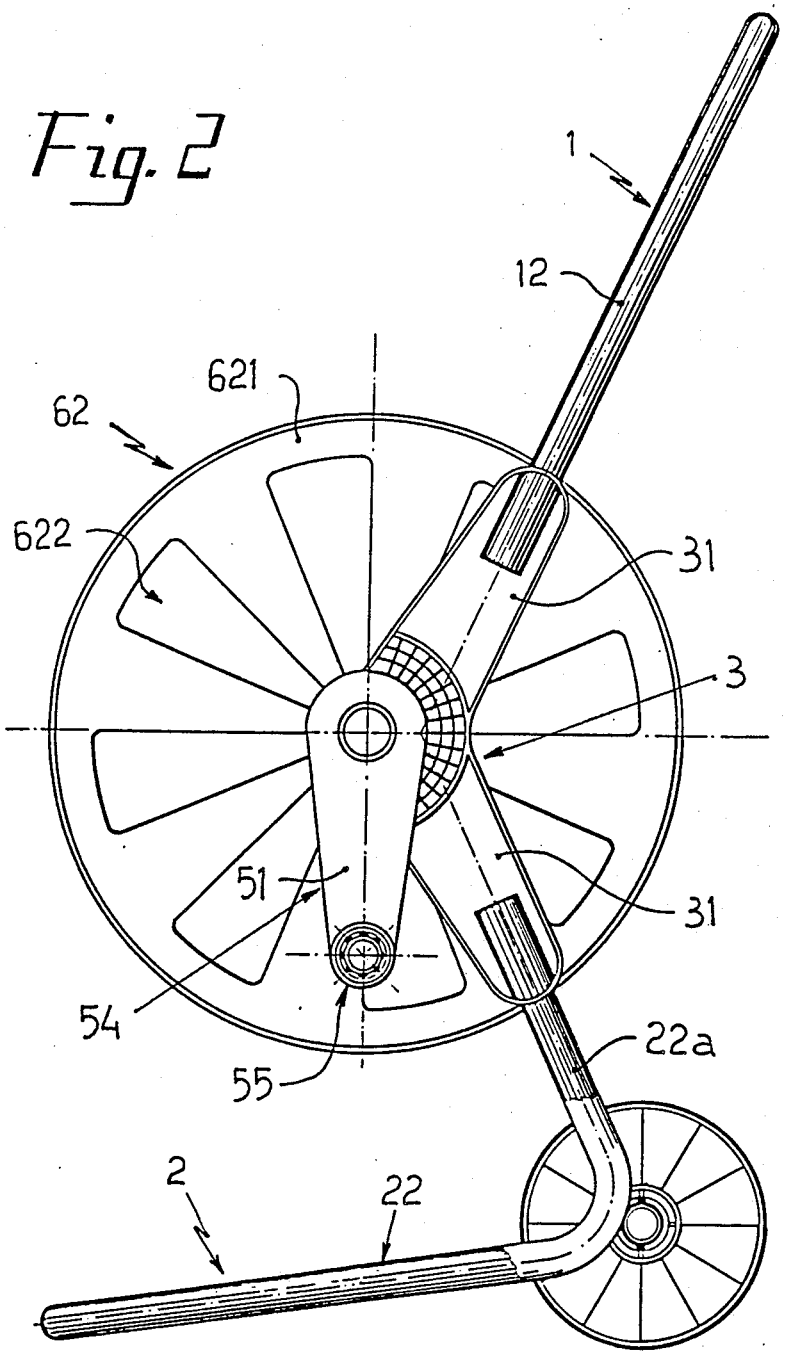
FIG. 2 shows the same cart of FIG. 1, in a side view thereof.
Figure 4:
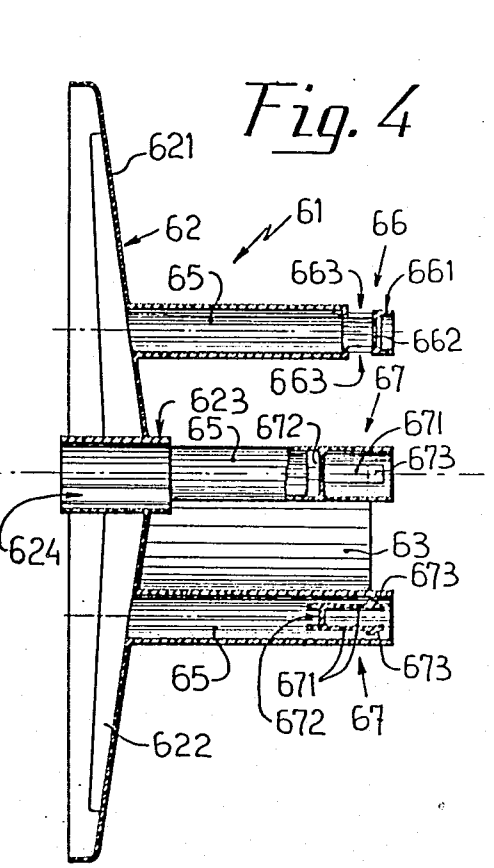
FIG. 4 is a side cross-sectional view of FIG. 3, taken along the line I—I.
Figure 3:
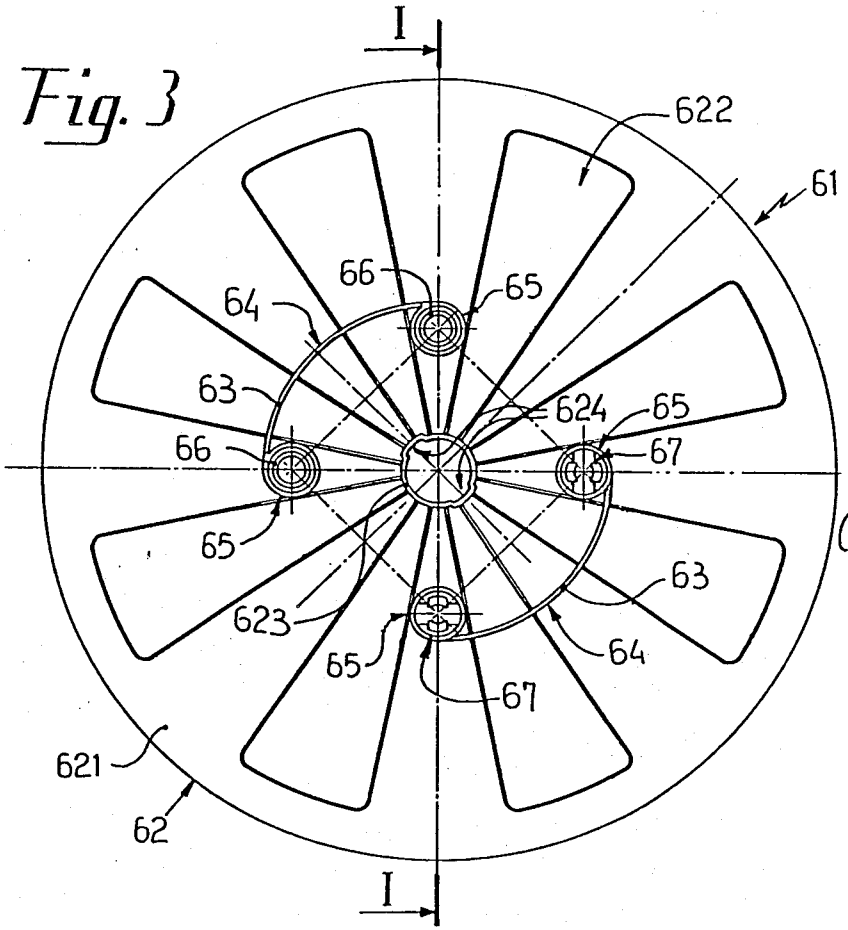
FIG. 3 shows an element forming a half-spool, in a front view taken from the inner side of the spool after assembly thereof.
Figure 6:
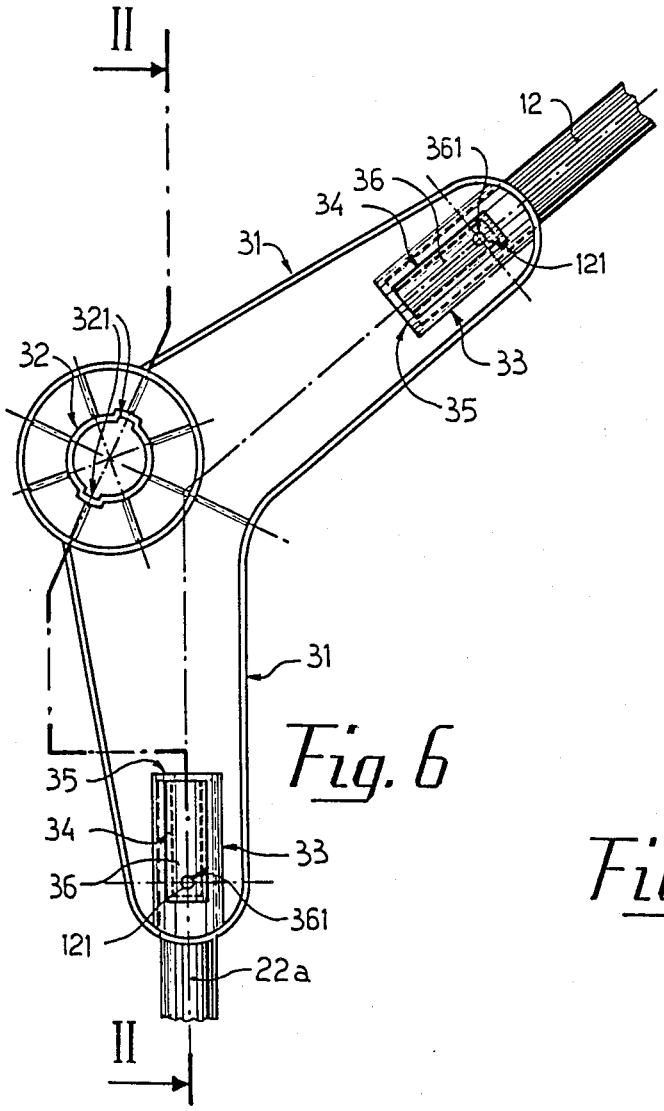
FIG. 6 is a front view of one of the lateral elements, connecting both the handle and the base and supporting the spool studs, which element is taken from the side thereof inside the cart after the assembling thereof.
Figure 7:
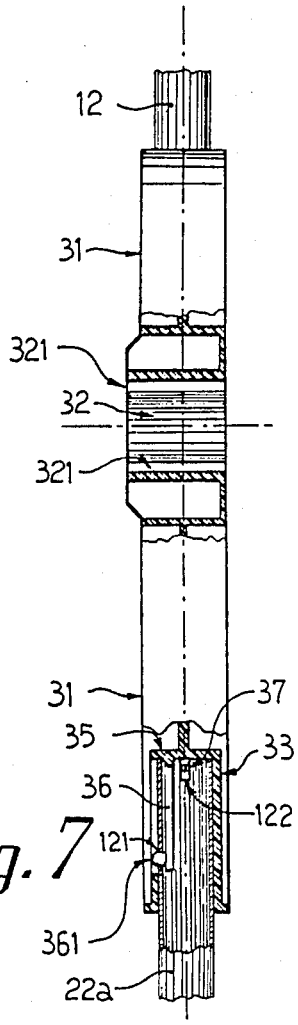
FIG. 7 shows the same element of FIG. 6, in a side view thereof with, some parts being cut-away along the lines II—II of FIG. 6.
Figure 8:
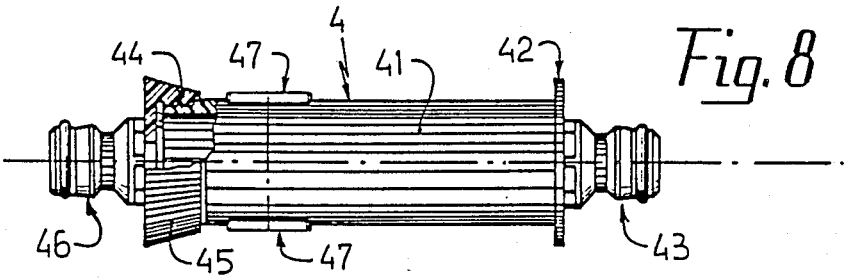
FIG. 8 shows, in a partial cut-away front view, the lateral stud acting also as a connection system for both the hose for the external connection and the hose to be wound around the spool.
Figure 9:
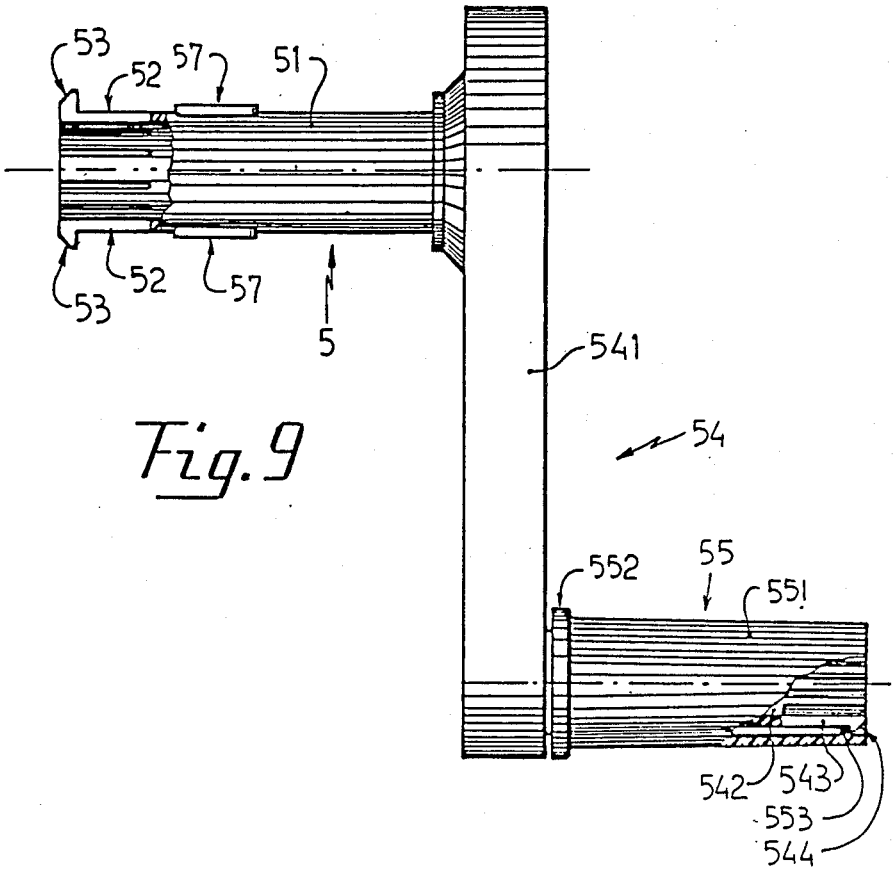
FIG. 9 shows, in a partial cut-away front view, the other lateral stud provided with a handle for winding the hose.
Figure 11:
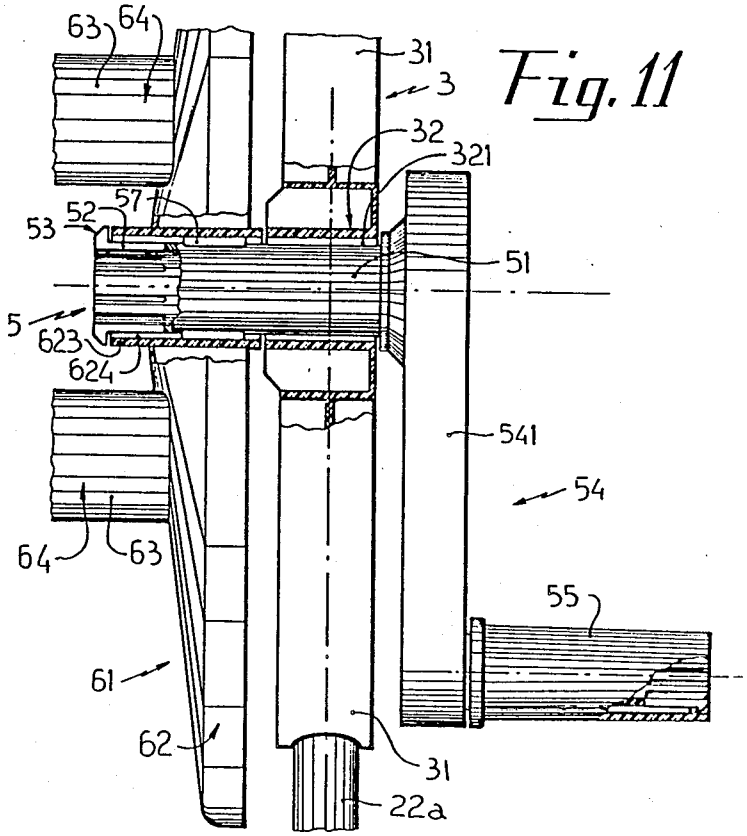
FIG. 11 is an enlarged view like that of FIG. 10, which illustrates the connection system for the lateral element which is opposite to the relevant half-spool, wherein such a connection system is obtained by means of the stud comprising the winding crank.
Figure 10:
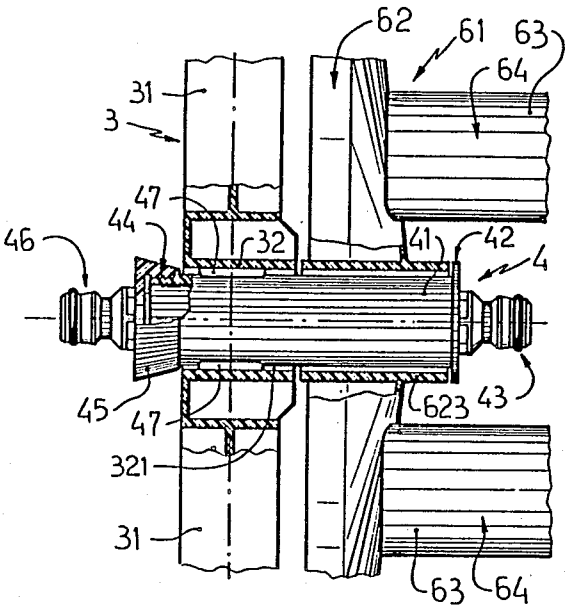
FIG. 10 shows, in a partial cut-away front view and in an enlarged scale, the connection systems of a lateral element to a corresponding half-spool, which is obtained by means of the stud acting as a connection element for both the hose for the external connection and the hose to be wound around the spool, as well as for the base element.
Figure 13:
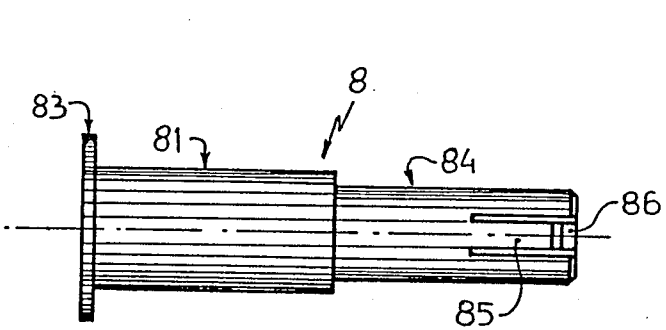
Figure 12:
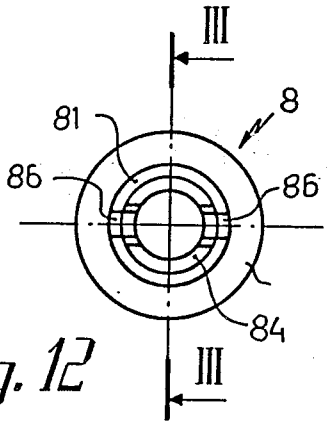
Figure 14:
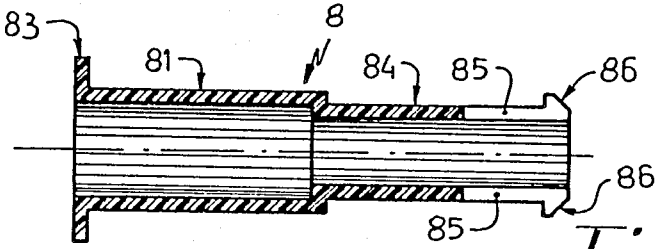

Referring to these figures and particularly to FIGS. 1, 2 and 6, it can be seen that the hose winding cart according to the present invention is constituted by the following component elements:

a handle 1 formed by an inverted "U" shaped metallic tube, which includes a transversal portion 11 having end portions from which two lateral arms 12 are orthogonally extended. Radially extending through holes 121 are provided near the free end portions of these arms facing each other for receiving respective coupling pins 361 of lateral elements 3, as will be hereinafter described. In addition, two opposite grooves 122 are also provided in the respective free end portions of the lateral arms 12, for purposes which will also be hereinafter described;

a base element 2, which is also formed by an "U" shaped metallic tube and includes, like the previously described handle 1, a support surface engaging transverse portion 21 having ends from which two lateral arms 22 are orthogonally extended therefrom, the ends of the lateral arms being bent slightly more than 90° back towards the transverse portion to form upwardly extending portions 22a provided with through holes 221 near the free ends thereof facing each other for receiving coupling pins 361 of the lateral elements 3 in the same manner as the above specified through holes 121 of the handle 1. Moreover, a transversal tubular portion 23 is connected, preferably by welding, at the vertices of the bent zones between the lateral arms 22 and the upwardly extending portions **22*a*, the ends of which portion are slightly projected beyond the outer sides of the structure of the base element 2. In addition, the transversal tubular portion 23 is provided near its ends with two diametrically opposite through holes 231, in which coupling teeth 85 of studs 8 of wheels 7 will be engaged (see also FIG. 15**), in a manner which will be hereinafter described.

a V-shaped lateral element 3 clearly illustrated with reference particularly to FIGS. 6 and 7, which element is formed by two tapered arms 31, joined at their wide ends to each other and appropriately tapered towards their narrower free ends, the arms 31 oriented to be convergent in such a manner as to form an angle of approximately 120° therebetween. A cylindrical bush 32 is formed on the element 3 at a position corresponding to a vertex zone equidistant from the free ends of the arms 31 and is provided with two longitudinal grooves 321, whose function will be described later. At the free ends of the two arms 31, there are provided two hollow cylindrical bodies 33, the bodies 33 being closed at an inner end 35 thereof facing the bush 32, each body 33 having an inner diameter which is equal to the outer diameter of the tubular ends of the lateral arms of either the handle 1 or the base 2, which engage with them in a manner which will be described as follows. The part of the hollow cylindrical bodies 33 which faces the inside of the cart, when the latter has been assembled, includes a longitudinal opening 34 extended for a sufficient length from the inner end 35 thereof, and a resilient tongue 36 is provided inside the opening 34 and is extended from the inner end 35 of the same, which resilient tongue 36 is provided with a coupling pin 361 capable of being engaged within a respective one of the through holes 121 or 122. In addition, a transversally extending relief 37 is provided on the inner end 35 of the cylindrical body 33 to permit the above specified two opposite grooves 122 to be engaged therewith, which grooves in turn are provided at the free ends of either lateral arms 12 of the handle 1 or the portions 22a of the base element 2, thereby preventing transversal movements of these free ends;

a first stud 4 clearly illustrated with reference particularly to FIG. 8, which is formed by a hollow cylindrical body 41 having an outer diameter equal to a respective one of the holes determined by the cylindrical bushes 32 of the lateral elements 3, as well as equal to the diameter of holes provided in cylindrical bushes 623, which in turn are disposed at the central zone of lateral flanges 62 of a winding spool 6. An annular flange 42 is provided adjacent one end of the first stud 4 which projects radially outwardly from the outer periphery thereof. Located between the end of the first stud 4 and the annular flange 42 is a first male part 43 of a quickly connecting joint. The other end of the first stud 4 terminates, on the other hand, with an outer threaded portion 44 in which a corresponding inner threaded ring nut 45 is engaged, form which a second male part 46 which is also of a quickly connecting joint, equal to the previous one, is extended. Moreover, two tongues 47 which are complementary to said longitudinal grooves 321 in which they may be engaged, are provided on the outer periphery of the first stud 4 near the threaded portion 44, in such a manner that the stud 4 is prevented from being rotated in the cylindrical bush 32, as will be described later;

a second stud 5, clearly illustrated in FIG. 9 which is formed by a hollow cylindrical body 51 having the same diameter as that of the first stud 4 and terminating at its free end with a plurality of longitudinal notches, which extend through the hollow cylindrical body 51 so as to define a plurality of resilient tongues 52 therebetween, the tongues being provided at their free ends with teeth 53 projecting radially outwardly therefrom, whose function will be described later. In addition, two tongues 57 which are complementary to longitudinal grooves 624 provided in the bush 623 of the spool 6 are provided on the outer periphery of the second stud 5 near the resilient tongues 52 which permits, as it will be hereinafter described, the tongues 57 to be engaged with the longitudinal grooves 624 so as to connect together both the spool 6 and a crank 54 extending from the opposite end of the second stud 5, which actuates the spool. One end of an arm 541 of the crank 54 extends radially from the other end of the stud 5 and a hollow cylindrical body 542 extends from the other end of the arm 541, which body constitutes a journal for a handle 55 of the crank 54. Also, this journal terminates at its free end with a plurality of resilient tongues 543, provided with radially outwardly projecting teeth 544 at their respective free ends thereof. The handle 55, in turn, is constituted by a tubular cylindrical body 551 having a raised edge 552 at one end thereof situated near the arm 541 and the tubular cylindrical body 551 is provided with a radially inwardly extending flange 553 near its other end. Clearly, by sliding the handle 55 over the relevant journal 542, the annular flange 553 bears against inclined front surfaces of the teeth 544, and pushes the ends of the resilient tongues 543 radially inwardly after which the tongues spring back outwardly as soon as the teeth 544 have passed over the annular flange 553, thereby engaging themselves against the latter and preventing the handle 55 from being extracted therefrom;

a half-spool 61 clearly illustrated in FIGS. 3 and 4 and constituted by a discoidal body 621, provided with suitable radially extending stiffening ribs 622 forming a lateral flange 62, wherein the discoidal body 621 comprises at its central zone a cylindrical bush 623 provided with two diametrically opposed longitudinally extending grooves 624, whose function will be described later. In addition, two diametrically and symmetrically opposed partly circular shells 63 extend longitudinally from the inwardly facing surface of the discoidal body 621, when the latter is assembled as described later, which shells constitute one half of the spool drum obtained in a manner which will be hereinafter described. Such partly circular shells 63 are provided with a curved surface 64 extending about ¼ of the corresponding circumference formed by the two shells, the lateral edges of each shell 63 being provided with longitudinally extending tubular cylindrical elements 65, which are disposed at the radially inner side thereof and terminate at their free ends with two male parts 66 on one of the shells 63 and two female parts 67 of snap connecting elements on the other one of the shells 63. Each of the two male parts 66 is constituted by a short tubular portion 661 having a reduced outer diameter, extending from the free end of the corresponding tubular cylindrical element 65 and provided inwardly thereof with a radially inwardly extending annular flange 662. Two diametrically opposed openings 663 extend through a portion of the tubular element 65 adjacent the short tubular portion 661. On the other hand, each of the two female parts 67 is constituted by two longitudinally extending resilient tongues 671 projecting from an inner transversal element 672 and terminating inside of and near the free end of the corresponding tubular cylindrical element 65. The tongues 671 are each provided with a radially outwardly extending tooth 673 engageable with the inner side of a respective annular flange 662 of the corresponding male part 66, thereby positioning the tooth in correspondence with one of the openings 663;

a wheel 7 clearly illustrated in FIG. 15 and constituted by a discoidal body 71, provided at its central part with a cylindrical bush 72 as well as a cylindrical body 73 at its peripheral part, which body is projected from the same side of the discoidal body 71 as the central cylindrical bush 72 and forms the rolling surface of the wheel 7;

a wheel stud 8 of the wheel 7, which is able to fix the wheel over a corresponding end of the transversal tubular portion 23 of the base element 2 described earlier. The wheel stud 8, clearly illustrated in FIGS. 9, 10 and 11, is constituted by a cylindrical body comprising a first portion 81 forming the effective stud of the wheel 7 and provided at its one end with a radially outwardly extending annular rim 83, as well as with a second reduced diameter cylindrical portion 84 extended therefrom at its other end, which portion has an outer diameter equal to the inner diameter of the transversal tubular portion 23, in which it will be introduced as described later. The free end of the second cylindrical portion 84, in turn, is provided with longitudinally extending notches which define a pair of diametrically opposed resilient tongues 85 therebetween' which are provided at their respective free ends with corresponding teeth 86, which are radially outwardly protruding therefrom and are engageable with corresponding holes 231 provided in the transversal tubular portion 23.

From the foregoing, it should be evident that the cart of the present invention may be assembled easily and in a very simple manner, and it also may be disassembled without the need of any tool.

In addition, the novel shapes of the single components thereof is such as to permit that most parts of the same components carry out double functions, a fact which permits a reduction of the means foreseen for their manufacture to be obtained. In the case referred to, this reduction is related to the molds. In fact, the wheels 7 and the relevant studs 8 thereof, the half-spools 61 and the lateral elements 3 are all symmetric elements which are disposed in an opposite symmetrical relationship to each other during the cart assembly. Such operations are now described, in order to provide a better understanding of the simplicity of the assembling and disassembling of the present cart.

To this purpose, two half-spools 61 are taken and disposed in an opposed position to each other, with the flanges 62 situated on the outside thereof and in such a manner that the respective snap connecting elements are positioned with the male parts 66 opposed to the corresponding female parts 67. Then, by pushing them against each other, these male and female parts are reciprocally interconnected until the teeth 673, provided on the ends of the resilient tongues 671 of the female parts 67, as they have passed over the respective annular flanges 662 provided on the inner side of the tubular portions 661 of the male parts 66, are engaged against the inner edge of the annular flanges 662 thereby ensuring a reciprocal connection of the two half-spools and consequently the assembling of the whole spool 6. Likewise, it is also possible to disconnect this spool simply by pressing the teeth 673 inwardly through an action exerted on the same by the tips of two fingers introduced within the openings 663.

Then, the support structure of the so obtained spool 6 is assembled by inserting, into the hollow cylindrical bodies 33 of the two lateral elements 3 which have been disposed in a reciprocal opposite relationship, the ends of the lateral arms 12 of the handle 1, at the one side, and the ends of the lateral arms 22 of the base element 2, at the other side thereof. This operation will continue until the coupling pins 361 provided on the ends of the resilient tongues 36, which in turn are provided, as already described, in the hollow cylindrical bodies 33, penetrate into the through holes 121, 122, which are provided in the respective ends of the lateral arms referred to. In this way, the handle 1 and the base element 2 are connected to the lateral elements 3. Also, in this case it is possible to have these components reciprocally disconnected, simply by pushing the coupling pins 361 inwardly, which action may be obtained by introducing a finger tip through a corresponding longitudinal opening 34.

It is to be noted that, as already specified, in the connected position thereof the opposite grooves 122 provided on the ends of the lateral arms 12 and 22 are themselves engaged within the corresponding transversal reliefs 37, so as to prevent such ends from being submitted to any transversal oscillation and consequently ensuring a considerably rigid connection.

Then, the wheels 7 and the spool 6 are assembled to the so obtained support structure. That is, the wheels 7 are assembled simply by inserting a stud 8 into the hole of the respective cylindrical bush 72 and then by inserting the second cylindrical portion 84 of the same stud in a corresponding end of the transversal tubular portion 23, which is fixed onto the base element 2 as already described until the teeth 86 of this stud penetrate into the corresponding holes 231 provided in such end of the transversal tubular portion 23. In this manner, the connection of the stud 8 is ensured and the wheel 7 is fixed, as it is supported by such a stud and retained between the edge of the end of the transversal tubular portion 23 and the annular rim 83, which is disposed on the outer end portion of the stud 8. Also, this connection is easily reversible, in fact it is sufficient to push the teeth 86 inwardly, always acting with the tips of two fingers, in order to extract the stud 8 therefrom and thus disassemble the respective wheels 7.

Finally, the spool 6 is assembled to the assembled support structure simply by inserting the first stud 4 into the corresponding cylindrical bush 32 of the two lateral elements 3, as well as into the corresponding cylindrical bush 623 of the lateral flanges 62 of the spool 6, at the one side thereof, and the second stud 5 into the same components at the other side thereof.

As shown in FIG. 10, the first stud 4 is inserted initially from the inner side of the spool 6 into the relevant cylindrical bush 623 and then into the cylindrical bush 32 of the corresponding lateral element 3, in such a manner that the tongues 47 of the same penetrate into the relative longitudinal grooves 321, which are provided within the cylindrical bush 32 as previously described. Afterwards, the relative inner threaded ring nut 45 is screwed onto the outer threaded portion 44, which is projected from the lateral element 3, so that the first stud 4 supports a lateral element 3 with the corresponding flange 62, so arranged as to be reciprocally fixed and retained between the annular flange 42, provided on the inner end of the stud 4, and the threaded ring nut 45.

On the other hand, the stud 5 is simply inserted initially into the cylindrical bush 32 of the other lateral element 3 and then into the cylindrical bush 623 of the corresponding lateral flange 62 of the spool 6, in which the respective tongues 57 penetrate into the corresponding longitudinal grooves 624 of the respective half-spool 61. Thus, the spool 6 is supported at both sides thereof and the crank 54 may drive in in rotation, as the crank 54 is connected to the spool by means of the connection constituted by the tongues 57 and the longitudinal grooves 624. The teeth 53 provided at the ends of the resilient tongues 52 will push the latter inwardly, while passing through the cylindrical bushes 32 and 623 and expand outwardly just after they have passed the inner edge of the cylindrical bush 623, so that these teeth will engage themselves with the inner edge of the cylindrical bush 623, thereby preventing the latter from being extracted therefrom. On the other hand, the relevant extraction thereof may be effected simply by pushing the teeth 53 inwardly, always acting on the same with only the tips of two fingers.

Thus, the hose winding cart referred to is completely assembled and may be always not only assembled but also disassembled in a very simple and easy manner, without the need of any tool, as clearly set forth above.

In addition, such a hose winding cart may be easily enlarged by using an enlargement element 9, clearly illustrated in FIGS. 16 and 17, which is similar to one of the partly circular shells 63 of the half-spool referred to above. In practice, the enlargement element 9 is constituted by a cylindrical surface portion 94, equal to the cylindrical surface 64 of the circular shells 63, the lateral edges of which are also provided with tubular cylindrical elements 95, which are also equivalent to the tubular cylindrical elements 65, wherein the tubular cylindrical elements 95 terminate with two male parts 96, at the one side thereof, and with two female parts 97 at the other side, which parts in turn are completely equal to the respective male parts 66 and female parts 67 of the circular shells 63 of the half-spools 61.

Figure 18:
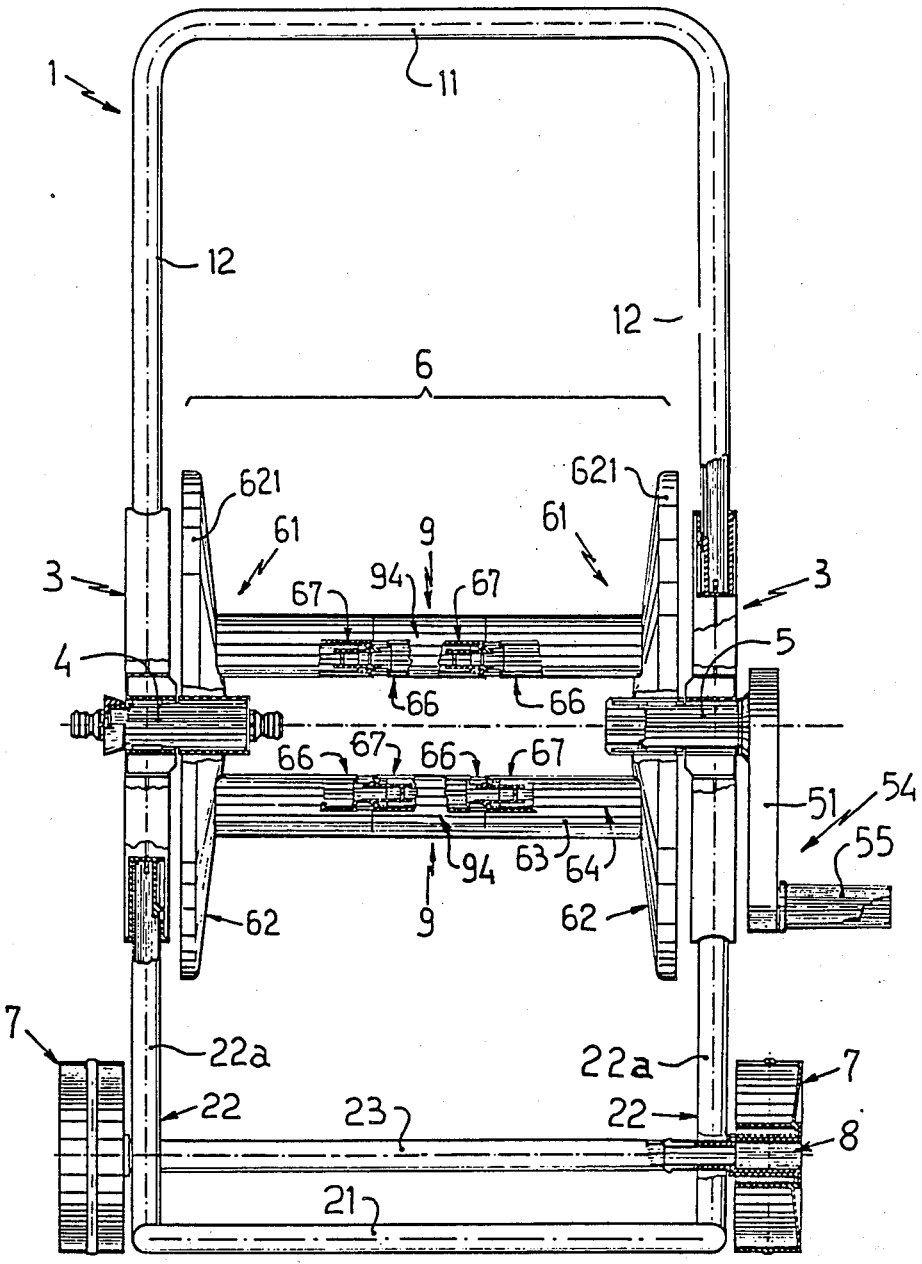
FIG. 18 shows, in a front view similar to FIG. 1, a cart provided with an enlarged spool, which has been obtained by means of the enlargement element illustrated in FIGS. 16 and 17.

In this manner, it is evident that by interposing one or more pairs of such enlargement elements 9 between two half-spools 61, it is possible to enlarge the spool 6 as much as one likes. FIG. 18 clearly illustrates a cart of the kind referred to, which has been enlarged by using a pair of such enlargement elements 9. Obviously, for the carts which have been enlarged it is required to use handles 1 and base elements 2 also having greater sizes, in the transversal direction thereof, while the other components of the carts remain always the same.

This cart permits various advantages to be obtained. In fact, the simplicity of the assembling and disassembling system thereof allows its components to be packed within small-sized boxes, which fact is particularly useful during both the packaging and the transport of the same components.

The invention which has been described, allows the use of elements having a double function, a fact which permits their manufacturing costs as well as the investment costs for the molds involved in their manufacture of be cut down.

Finally, due to the possibility of inserting one or more enlargement elements 9 between the two half-spools, it is possible to obtain hose winding carts with greater sizes and therefore greater performance by utilizing elements which are equal for the most part.

Likewise, the same inventive concept described herein may also be advantageously applied on similar devices, particularly on small-sized portable hose winding apparatus, which normally are not provided with an effective cart structure with relevant wheels.

It will be understood by those skilled in the art that while the cart of the present invention has been described with reference to the foregoing embodiments, various changes and modifications may be made thereto without departing from the scope of the appended claims.

We claim:

1. A hose winding cart, comprising:

a handle;

a base;

a pair of lateral elements, said lateral elements being connected to said handle and said base at positions which are spaced apart in a longitudinal direction;

a reel for winding a hose thereon, said reel including a pair of reel halves, each of said reel halves having snap connection means thereon for interconnecting said reel halves to form said reel;

a first stud connected between one of said lateral elements and one of said reel halves for rotatably supporting one side of said reel, said first stud having means thereon for supplying a fluid medium to a hose carried by said reel; and a second stud connected between the other one of said lateral elements and the other one of said reel halves for rotatably supporting the other side of said reel.

2. The hose winding cart of claim 1, wherein said pair of lateral elements are identical in shape.

3. The hose winding cart of claim 1, wherein said pair of reel halves are identical in shape.

4. The hose winding cart of claim 3, wherein said snap connection means comprises at least one male part and at least one female part on each of said reel halves, said male part on one of said reel halves being snap fitted in said female part in the other one of said reel halves when said reel halves are assembled to form said reel.

5. The hose winding cart of claim 1, further comprising enlargement element means for increasing the size of said reel in said longitudinal direction, said enlargement element means comprising at least one enlargement element having snap connection means thereon for interconnecting said reel halves together with said enlargement element therebetween.

6. The hose winding cart of claim 5, wherein said snap connection means comprises at least one male part and at least one female part on each of said reel halves and on opposite sides of said interconnecting element, said male part and said female part on one of said reel halves being snap fitted in said female part and said male part, respectively, on one side of said interconnecting element and said male part and said female part on the other one of said reel halves being snap fitted in said female part and said male part, respectively, on the other side of said interconnecting element.

7. The hose winding cart of claim 1, further comprising wheel means mounted on said base element for rotatably supporting said cart during travel thereof on a support surface.

8. The hose winding part of claim 7, wherein said wheel means comprises at least one wheel and at least one wheel stud, said base including a tubular portion and said wheel stud including snap connection means for interconnecting said wheel stud to said tubular portion, said wheel having a bush thereon for receiving said wheel stud, whereby said wheel can be mounted on said base by inserting said wheel stud into said bush and snap fitting said wheel stud to said tubular portion.

9. The hose winding cart of claim 8, wherein said snap connection means comprises at least one resilient tongue extending in said longitudinal direction and having a radially outwardly extending projection thereon and said tubular portion has an opening sized to receive said projection when said wheel stud is inserted into said tubular portion.

10. The hose winding cart of claim 1, wherein said second stud includes snap connection means for interconnecting said second stud to the other one of said reel halves.

11. The hose winding cart of claim 10, wherein said snap connection means comprises at least one resilient tongue extending in said longitudinal direction and having a radially outwardly extending projection thereon, said other one of said reel halves having a bush therein for receiving said second stud, said projection being movable radially inwardly during insertion of said second stud in said bush and being movable radially outwardly into engagement with means on said bush for preventing removal of said second stud when said second stud is inserted into said bush.

12. The hose winding assembly of claim 1, further comprising a crank connected to said second stud and means on said second stud engaging said other one of said reel halves for preventing rotation thereof with respect to said second stud; whereby said reel can be rotated by turning said crank.

13. The hose winding cart of claim 1, wherein each of said lateral elements includes snap connection means for connecting said handle to said lateral elements, said snap connection means comprising at least one resilient tongue having a radially extending projection thereon, said handle including a pair of laterally spaced-apart arms, each of said arms being slidably received in a cylindrical body disposed on a respective end of one of said lateral elements and each of said arms having an opening therein sized to receive said projection when said arm is inserted into said cylindrical body.

14. The hose winding cart of claim 1, wherein each of said lateral elements includes snap connection means for connecting said base to said lateral elements, said snap connection means comprising at least one resilient tongue having a radially extending projection thereon, said base including a pair of laterally spaced-apart portion, each of said portions being slidably received in a cylindrical body disposed on a respective end of one of said lateral elements and each of said portions having an opening therein sized to receive said projection when said portion is inserted into said cylindrical body.

15. A hose winding cart, comprising:

a handle;

a base;

a pair of identically shaped lateral elements, said lateral elements being connected to said handle and said base at positions which are spaced apart in a longitudinal direction;

a reel for winding a hose thereon, said reel including a pair of identically shaped reel halves, each of said reel halves having snap connection means thereon for interconnecting said reel halves to form said reel, said snap connection means comprising at least one male part and at least one female part on each of said reel halves, said male part on one of said reel halves being snap fitted in said female part in the other one of said reel halves when said reel halves are assembled to form said reel;

a first stud connected between one of said lateral elements and one of said reel halves for rotatably supporting one side of said reel, said first stud having means thereon for supplying a fluid medium to a hose carried by said reel; and a second stud connected between the other one of said lateral elements and the other one of said reel halves for rotatably supporting the other side of said reel, said second stud including snap connection means for interconnecting said second stud to the other one of said reel halves, said snap connection means comprising at least one resilient tongue extending in said longitudinal direction and having a radially outwardly extending projection thereon, said other one of said reel halves having a bush therein for receiving said second stud, said projection being movable radially inwardly during insertion of said second stud in said bush and being movable radially outwardly into engagement with means on said bush for preventing removal of said second stud when said second stud is inserted into said bush.

16. The hose winding cart of claim 15, further comprising wheel means mounted on said base, said wheel means comprising at least one wheel and at least one wheel stud, said base including a tubular portion and said wheel stud including snap connection means for interconnecting said wheel stud to said tubular portion, said wheel having a bush thereon for receiving said wheel stud, whereby said wheel can be mounted on said base by inserting said wheel stud into said bush and snap fitting said wheel stud to said tubular portion.

17. The hose winding cart of claim 16, wherein said snap connection means comprises at least one resilient tongue extending in said longitudinal direction and having a radially outwardly extending projection thereon and said tubular portion has an opening sized to receive said projection when said wheel stud is inserted into said tubular portion.

18. The hose winding cart of claim 15, wherein each of said lateral elements includes snap connection means for connecting said handle to said lateral elements, said snap connection means comprising at least one resilient tongue having a radially extending projection thereon, said handle including a pair of laterally spaced-apart arms, each of said arms being slidably received in a cylindrical body disposed on a respective end of one of said lateral elements and each of said arms having an opening therein sized to receive said projection when said arm is inserted into said cylindrical body.

19. The hose winding cart of claim 15, wherein each of said lateral elements includes snap connection means for connecting said base to said lateral elements, said snap connection means comprising at least one resilient tongue having a radially extending projection thereon, said base including a pair of laterally spaced-apart portions, each of said portions being slidably received in a cylindrical body disposed on a respective end of one of said lateral elements and each of said portions having an opening therein sized to receive said projection when said portion is inserted into said cylindrical body.

20. A hose winding cart, comprising:

a handle;

a base;

a pair of identically shaped lateral elements, said lateral elements being connected to said handle and said base at positions which are spaced apart in a longitudinal direction;

a reel for winding a hose thereon, said reel including a pair of identically shaped reel halves, each of said reel halves having snap connection means thereon for interconnecting said reel halves to form said reel, said snap connection means comprising at least one male part and at least one female part of each of said reel halves, said male part on one of said reel halves being snap fitted in said female part on the other one of said reel halves when said reel halves are assembled to form said reel;

a first stud connected between one of said lateral elements and one of said reel halves for rotatably supporting one side of said reel, said first stud having means thereon for supplying a fluid medium to a hose carried by said reel; and enlargement element means for increasing the size of said reel in said longitudinal direction, said enlargement element means comprising at least one enlargement element having snap connection means thereon for interconnecting said reel halves together with said enlargement element therebetween, said snap connection means comprising at least one male part and at least one female part on each of said reel halves and on opposite sides of said interconnecting element, said male part and said female part on one of said reel halves being snap fitted in said female part and said male part, respectively, on one side of said interconnecting element and said male part and said female part on the other one of said reel halves being snap fitted in said female part and said male part, respectively, on the other side of said interconnecting element;

wheel means mounted on said base element for rotatably supporting said cart during travel thereof on a support surface, said wheel means comprising at least one wheel and at least one wheel stud, said base including a tubular portion and said wheel stud including snap connection means for interconnecting said wheel stud to said tubular portion, said wheel having a bush thereon for receiving said wheel stud, whereby said wheel can be mounted on said base by inserting said wheel stud into said bush and snap fitting said wheel stud to said tubular portion, said snap connection means comprising at least one resilient tongue extending in said longitudinal direction and having a radially outwardly extending projection thereon and said tubular portion having an opening sized to receive said projection when said wheel stud is inserted into said tubular portion;

a second stud connected between the other one of said lateral elements and the other one of said reel halves for rotatably supporting the other side of said reel, said second stud including snap connection means for interconnecting said second stud to the other one of said reel halves, said snap connection means comprising at least one resilient tongue extending in said longitudinal direction and having a radially outwardly extending projection thereon, said other one of said reel halves having a bush therein for receiving said second stud, said projection being movable radially inwardly during insertion of said second stud in said bush and being movable radially outwardly into engagement with means on said bush for preventing removal of said second stud when said second stud is inserted into said bush, said second stud further including a crank connected thereto and means on said second stud engaging said other one of said reel haves for preventing rotation thereof with respect to said second stud, whereby said reel can be rotated by turning said crank.

* * * * *

UNITED STATES PATENT AND TRADEMARK OFFICE

CERTIFICATE OF CORRECTION

PATENT NO. : 4,768,546

DATED : September 6, 1988

INVENTOR(S) : Giacomo Brusadin et al

It is certified that error appears in the above-identified patent and that said Letters Patent is hereby corrected as shown below:

On the title page Assignee should read

-- Uniflex Utiltime S.p.A. --.

Signed and Sealed this

Eleventh Day of April, 1989

*Attest:*

DONALD J. QUIGG

*Attesting Officer*

*Commissioner of Patents and Trademarks*